US009265316B2

(12) United States Patent
Diaz

(10) Patent No.: US 9,265,316 B2
(45) Date of Patent: Feb. 23, 2016

(54) PERSONAL ELECTRONIC DEVICE HANDBAG

(76) Inventor: Priska I. Diaz, Corona, NY (US)

( * ) Notice: Subject to any disclaimer, the term of this patent is extended or adjusted under 35 U.S.C. 154(b) by 2 days.

(21) Appl. No.: 13/573,214

(22) Filed: Aug. 30, 2012

(65) Prior Publication Data

US 2014/0061068 A1 Mar. 6, 2014

(51) Int. Cl.

| | |
|---|---|
| ***A45C 3/00*** | (2006.01) |
| ***A45C 3/06*** | (2006.01) |
| ***A45C 15/00*** | (2006.01) |
| ***A45C 15/06*** | (2006.01) |
| *A45C 11/00* | (2006.01) |

(52) U.S. Cl.

CPC . *A45C 3/06* (2013.01); *A45C 15/00* (2013.01); *A45C 15/06* (2013.01); *A45C 2011/002* (2013.01)

(58) Field of Classification Search

CPC ..... A45C 13/00; A45C 13/025; A45C 2011/002; A45C 15/00; A45C 3/00; A45C 2013/025; A45C 3/06; A45C 15/06

USPC ..... 190/109, 114, 901; 150/106, 111; 206/37

See application file for complete search history.

(56) References Cited

U.S. PATENT DOCUMENTS

| | | | | | |
|---|---|---|---|---|---|
| 299,812 | A * | 6/1884 | Lazarus | 190/3 |
| 470,783 | A * | 3/1892 | Dobbs | 396/341 |
| 752,756 | A * | 2/1904 | Christie | 190/109 |
| 792,183 | A * | 6/1905 | Tiderman | 190/114 |
| 1,502,987 | A * | 7/1924 | Glass et al. | 190/111 |
| 1,555,127 | A * | 9/1925 | Lending | 150/106 |
| 1,915,007 | A * | 6/1933 | Weiss | 206/581 |
| 1,983,036 | A * | 12/1934 | Kaufmann | 190/109 |
| 2,055,657 | A * | 9/1936 | Gordon | 312/209 |
| 3,041,638 | A * | 7/1962 | Lo Vico | 5/419 |
| 5,348,347 | A * | 9/1994 | Shink | 281/31 |
| 5,590,771 | A * | 1/1997 | Cota | 206/314 |
| 5,607,054 | A * | 3/1997 | Hollingsworth | 206/320 |
| 6,047,752 | A | 4/2000 | Southwick | |
| 6,269,948 | B1 * | 8/2001 | Jackson | 206/320 |
| 6,330,961 | B1 | 12/2001 | Borja | |
| 6,892,880 | B2 * | 5/2005 | Nieves | 206/320 |
| 7,090,076 | B2 | 8/2006 | Hartstein et al. | |
| 7,458,920 | B2 * | 12/2008 | Hallar | 482/104 |
| D616,644 | S | 6/2010 | Ramon | |
| 8,028,872 | B2 | 10/2011 | Hamlin | |
| 8,132,601 | B2 | 3/2012 | Wang | |
| 8,225,973 | B1 | 7/2012 | Bellinson | |
| 2002/0023812 | A1 * | 2/2002 | Bernbaum et al. | 190/111 |
| 2005/0232585 | A1 * | 10/2005 | Lavelle et al. | 386/46 |
| 2009/0229936 | A1 * | 9/2009 | Cuong et al. | 190/107 |
| 2012/0043231 | A1 * | 2/2012 | Perrier et al. | 206/216 |

FOREIGN PATENT DOCUMENTS

| | | | |
|---|---|---|---|
| DE | 29519332 | * | 1/1996 |
| DE | 29519332 U1 | * | 1/1996 |

* cited by examiner

*Primary Examiner* — Sue A Weaver

(74) *Attorney, Agent, or Firm* — The Law Firm of Andrea Hence Evans, LLC

(57) ABSTRACT

A personal electronic device handbag includes: (a) a main support with three connected fold-out panels including one base panel located between other panels; (b) a personal electronic device holding case located on the base panel; (c) at least two storage units having sides and a bottom, such that the main support has a first position, wherein the panels are folded and at least two of the storage unit bottoms rest atop the holding case and any personal electronic device therein to protect such personal electronic device, and has a second position, being an open position.

16 Claims, 12 Drawing Sheets

Figure 18
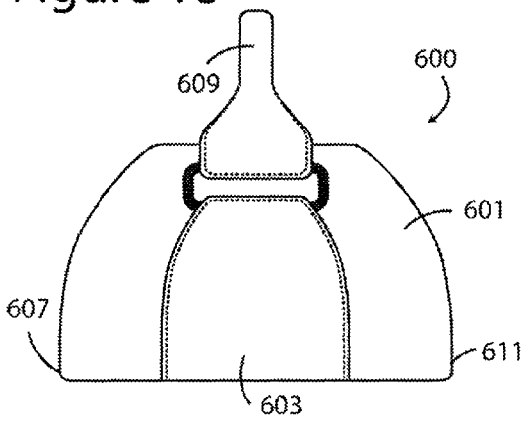
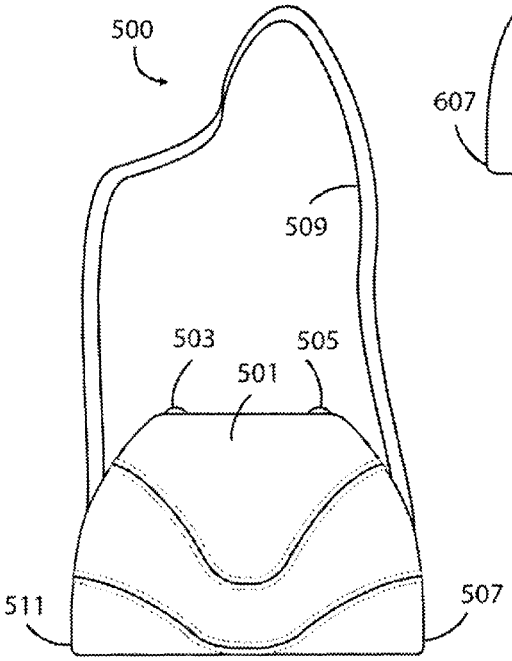
Figure 17
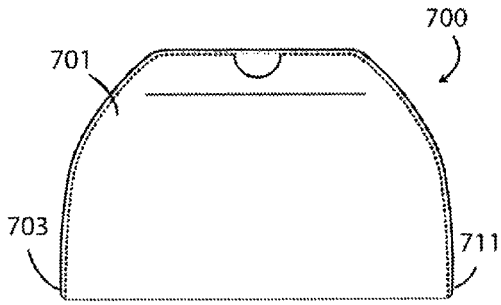
Figure 19

PERSONAL ELECTRONIC DEVICE HANDBAG

BACKGROUND OF INVENTION a. Field of Invention

The invention relates generally to a handbag that has a unique functional arrangement of components so that a number of desirable objectives are achieved simultaneously. These include maintaining a personal electronic device in a substantially horizontal position in the handbag with its screen facing up for easy use without ever needing reorientation, provision of at least two separate pocketbook or purse-like storage units, panels that provide multiple functions and more specifically allow for positioning thereof in closed and open positions to respectively protect and then expose the personal electronic device for use, and allow for plug-in recharging of the personal electronic device from an open side without the need to open the handbag. By "personal electronic device" is meant a mobile phone, PDA, digital music player, mini internet device or similar electronic device that utilizes mini-keyboard or touch screen functioning and has a screen.

b. Description of Related Art

The following patents and applications are representative of various types of inventions that may be related in some manner to the present invention:

U.S. Pat. No. 6,047,752 to Southwick describes a handbag system having a substantially rectangular body with an open middle compartment. Within the middle compartment are a plurality of sub-compartments sized for holding various personal safety items such as mace, a wireless phone and a pager. A closure flap is provided for partially covering the middle compartment. The closure flap is sized and arranged to allow unrestricted access to those personal safety items which are adjacent to the sides of the body when the closure flap is in a closed position. A closeable front and rear compartment are provided to store other miscellaneous personal items.

U.S. Pat. No. 6,330,961 B1 to Borja describes an elongated pouch having various storage pockets thereon is provided, for storage of personal articles therein, and is mounted upon a forearm of a user of the pouch such as the driver of an automobile. A personnel communicator device is positioned within the pouch, the personnel communicator device having a data transmission portion, typically a keyboard and a character display screen, facing the driver of the vehicle for facilitating data exchange between the driver and the personnel communicator device while operating the vehicle. The screen generated characters are displayed along a line parallel to the length of the forearm of the driver of the vehicle to facilitate easy reading of the characters by the driver of the vehicle.

U.S. Pat. No. 7,090,076 B2 to Hartstein et al. describes a handbag for housing a cell phone/Personal Digital Assistant (PDA) and containing a compartment for personal items is disclosed. The housing provisions include circuitry between inner lining and outer shell of handbag interconnecting various compartments therewithin, including backup battery compartment and a touch-operated screen (operable from the exterior). The handbag also has modular outlets to physically connect and integrate the cell phone/PDA system and an antenna to facilitate wireless connection.

U.S. Pat. No. 8,028,872 B2 to Hamlin describes a utility pocket for use with a tool pouch or bag, or with such items as a brief case, soft sided cooler, or a backpack. The utility pocket has a clam shell shaped outer member which is biased toward an associated sidewall panel by means of elastic webbing. A pair of mating permanent magnets come into contact as the pocket moves from the open position to the closed position and helps to bias the pocket to the closed position, as well as imparting a snap-closure action to the pocket. The material chosen for the pocket helps it to retain its clam shell shape without requiring internal reinforcing members, such as wire springs or other metal reinforcing elements.

U.S. Pat. No. 8,132,601 B2 to Wang describes a tote bag for being partitioned or alternatively expanded. The bag has a partition mode and an expansion mode and includes a front panel, a rear panel, and a pair of side panels. The front panel is attached to the rear panel by the pair of side panels. The pair of side panels fold and attach to each other to form a partition thereby dividing the tote bag into a pair of compartments when the tote bag is in the partition mode thereof and separate from each other and unfold to eliminate the partition thereby expanding the tote bag when the tote bag is in the expansion mode thereof.

U.S. Pat. No. 8,225,973 B1 to Bellinson describes a personal garment apparatus resembling a holster-like shoulder bag that is worn over a person's shoulder having a plurality of pouches and pockets to store and transport various articles. The presently defined preferred embodiment consists of: three front pockets for a cell phone, a palm pilot, a USB key, a MP3 player, money clip, etc.; another larger zipper pocket situated behind the flap pockets to hold flat items like a checkbook, a passport, tickets, etc.; an adjustable strap to customize the shoulder fit for most people; and, a set of attachment clips allowing the invention to be reversed for wear on either shoulder. Besides being a new fashion accessory, the invention's functionalities are intended to provide easier access and increased comfort when compared to similar items being carried on a belt, about the waist or in pockets.

U.S. Design Pat. No. D616,644 S to Ramon shows a multi-compartment accessory holder to be attached to the arm of a user.

Notwithstanding the prior art, the present invention is neither taught nor rendered obvious thereby.

SUMMARY OF INVENTION

The present invention is directed to a personal electronic device handbag, that includes: (a) a main support having at least three connected fold-out panels including at least one of the fold-out panels being a base panel located between other panels, and at least two fold areas located between the panels; (b) a personal electronic device holding case located on and attached to the base panel, the holding case having sides with securing means for securing a personal electronic device thereto; (c) at least two storage units having sides and a bottom, at least one of said at least two storage units is a bag storage unit, at least one of each being connected at its side to panels on opposite sides of the base panel, such that the main support has a first position, being a closed position, wherein the panels are folded and at least two of the storage unit bottoms rest atop the holding case and any personal electronic device therein to protect such personal electronic device, and has a second position, being an open position, wherein the panels are unfolded and at least two storage unit bottoms are not resting upon the holding case so as to expose the holding case and any personal electronic device therein for use of the personal electronic device.

In some preferred embodiments of the present invention personal electronic device handbag, the personal electronic device holding case is positioned on a base panel of the main support so as to receive a personal electronic device with its back facing the base panel and its front facing upward and available for use while positioned in the holding case when the main support is in its open position.

In some preferred embodiments of the present invention personal electronic device handbag, the main support and the personal electric device holding case have sufficient open areas to permit recharging of a personal electric device while stored in the holding case and while the main support is in its closed position.

In some preferred embodiments of the present invention personal electronic device handbag, at least three connected fold out panels are rigid.

In some preferred embodiments of the present invention personal electronic device handbag, at least one base panel is rigid and the remaining panels are non-rigid.

In some preferred embodiments of the present invention personal electronic device handbag, the handbag further includes a cover flap having a first end and a second end, and being permanently connected at one end to the main support and being removably connected to the other end of said main support.

In some preferred embodiments of the present invention personal electronic device the handbag, main support has at least one carrying strap attached to the main support.

In some preferred embodiments of the present invention personal electronic device handbag, the handbag main support has two carrying straps attached to the main support.

In some preferred embodiments of the present invention personal electronic device handbag, each of the at least one storage unit has closure means selected from the group consisting of zipper, magnetic, hook and loop, snap and clasp.

In some preferred embodiments of the present invention personal electronic device handbag, it includes: (a) a main support having three connected fold-out panels including one of the fold-out panels being a central base panel located between other two panels, and two fold areas located between the panels; (b) a personal electronic device holding case located on and attached to the central base panel, the holding case having sides with securing means for securing a personal electronic device thereto; (c) at least one storage unit having sides and a bottom, at least one of said at least two storage units is a bag storage unit, at least one of each being connected at its side to panels on opposite sides of the central base panel, such that the main support has a first position, being a closed position, wherein the panels are folded and at least two of the storage bag unit bottoms rest atop the holding case and any personal electronic device therein to protect such personal electronic device, and has a second position, being an open position, wherein said panels are unfolded and at least two storage unit bottoms are not resting upon the holding case so as to expose the holding case and any personal electronic device therein for use of the personal electronic device. In some of these preferred embodiments of the present invention personal electronic device handbag the personal electronic device holding case is positioned on a central base panel of the main support so as to receive a personal electronic device with its back facing the central base panel and its front facing upward and available for use while positioned in the holding case when the main support housing is in its open position. In some of these preferred embodiments of the present invention personal electronic device handbag the main support and the personal electric device holding case have sufficient open areas to permit recharging of a personal electric device while stored in the holding case and while the main support is in its closed position. In some of these preferred embodiments of the present invention personal electronic device handbag at least three connected fold out panels are rigid. In some of these preferred embodiments of the present invention personal electronic device at least one central base panel is rigid and the remaining panels are non-rigid. In some of these preferred embodiments of the present invention personal electronic device handbag the handbag further includes a cover flap having a first end and a second end, and being permanently connected at one end to the main support and being removably connected. In some of these preferred embodiments of the present invention personal electronic device handbag, the handbag main support has at least one carrying strap attached to the main support. In some of these preferred embodiments of the present invention personal electronic device handbag, the handbag main support has a bottom orifice at its central base panel positioned for alignment with a camera lens of a personal electronic device. In some of these preferred embodiments of the present invention personal electronic device handbag, each of the at least two storage bag units have closure means selected from the group consisting of zipper, magnetic, hook and loop, snap and clasp.

In some preferred embodiments of the present invention personal electronic device handbag, at least two storage units include at least two bag storage units.

In some preferred embodiments of the present invention personal electronic device handbag, the external component has a material of construction selected from the group consisting of synthetic fabric, molded plastic, natural fabric, leather and combination thereof.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
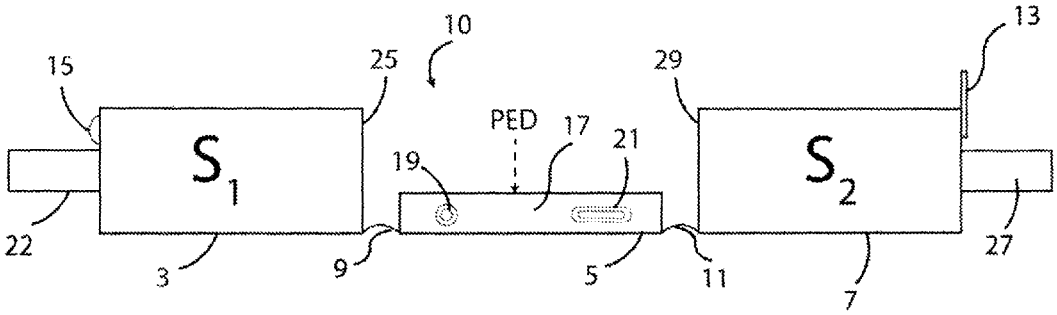
FIG. 1 is shows a basic representation of an embodiment of the present invention personal electronic device handbag in its open position and FIG. 2 shows the same conceptual presentation in its closed position.
Figure 2:
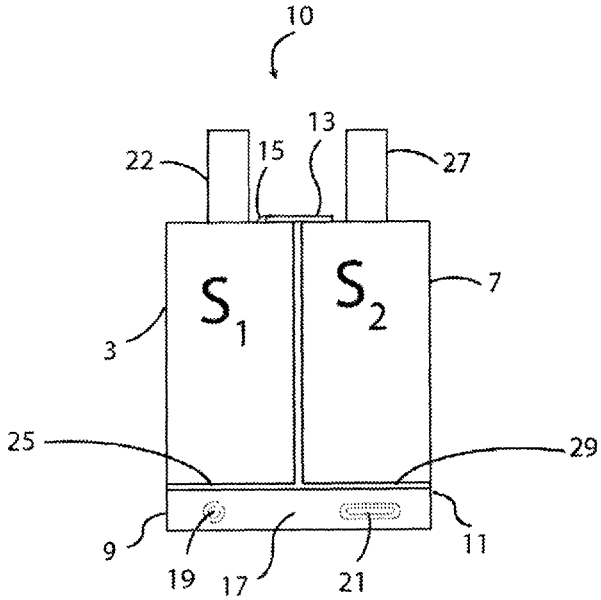

FIG. 1 is shows a basic representation of an embodiment of the present invention personal electronic device handbag 10 in its open position and FIG. 2 shows the same conceptual presentation in its closed position. Present invention handbag 10 includes: (a) a main support having three connected fold-out panels, one of the fold-out panels is a base panel 5 located between the other panels, namely left panel 3 and right panel 5. There are two fold areas 9 and 11 located between the panels 3, 5 and 7, as shown. A personal electronic device holding case 17 is located on and attached to the base panel 5. The holding case 17 has sides with securing means for securing a personal electronic device (not shown) thereto. These are two storage units, $S_1$ and $S_2$, each with sides and a bottom. Storage unit $S_1$ is a bag storage unit with a bottom 25 and with its side connected to or physically part of left panel 3. Likewise, storage unit $S_2$ is a bag storage unit with a bottom 29 and with its side connected to or physically part of right panel 7. In general, at least one of at least two storage units is a bag storage unit, but in this case both are bag storage units. One of each storage unit is connected at its side to a panel, i.e., panels, 3 and 7, respectively, so as to be on opposite sides of the base panel 5, as shown. The main support has a first position, being a closed position, shown in FIG. 2, wherein the panels 3, 5 and 7 are folded and the storage unit bottoms 25 and 29 rest atop the holding case 17 and any personal electronic device (not shown) therein to protect such personal electronic device, and has a second position, being an open position, shown in FIG. 1, wherein the panels 3, 5 and 7 are unfolded and the storage unit bottoms 25 and 29 are not resting upon the holding case 17 so as to expose the holding case 17 and any personal electronic device therein, for use of the personal electronic device. Holding case 17 has open ends for functional aspects of the personal electronic device, and here, at this end, holding case 17 has orifices 19 and 21 to expose functional parts of the personal electronic device. The opposite end of holding case 17 (not shown) likewise has functional orifices, e.g. a charge socket opening.

While the storage units $S_1$ and $S_2$ shown in FIGS. 1 and 2 are shown as rectangular, they could have any shape without exceeding the scope of the present invention further, in these block or stick type drawings, access to the storage units $S_1$ and $S_2$ are not shown. These may be zippers, magnetic closers, hook and loop closers, buttons, snaps, clasps or any other hand bag closer mechanism. Additionally, the panels 3, 5 and 7 may be a single sheet or may be connected (heat sealed, glued, sewn or otherwise). These panels may all be flexible, all rigid or mixed. The top closer in FIGS. 1 and 2, a snap with latch 13 and receiver 15, keep the bag storage unit $S_1$ and $S_2$ together for carrying bag straps 22 and 27. Any type of closer mechanism may be used.

Figure 3:
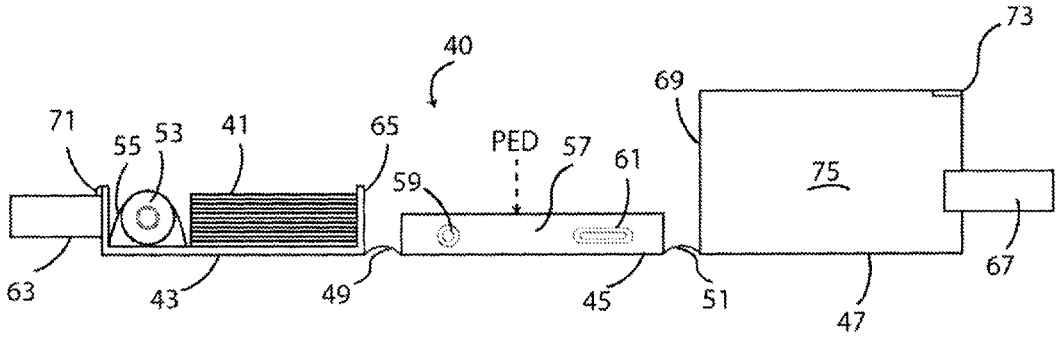
FIGS. 3 and 4 show another embodiment of a representation of the present invention wherein the storage units are different and one includes a pad and pen holder.
Figure 4:
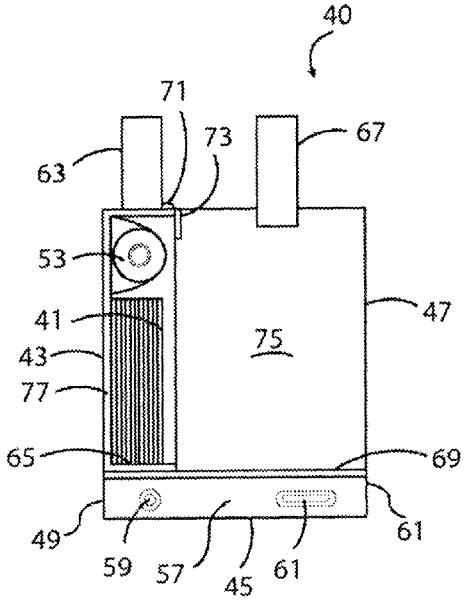
Figure 5:
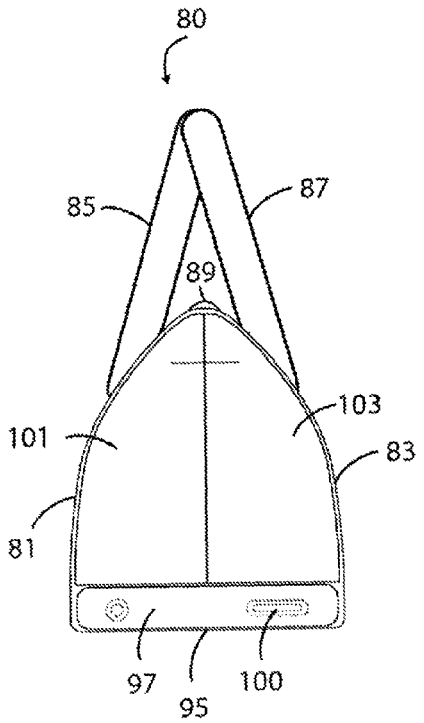
FIG. 5 is a left side view of yet another embodiment of the present invention personal electronic device handbag.
Figure 6:
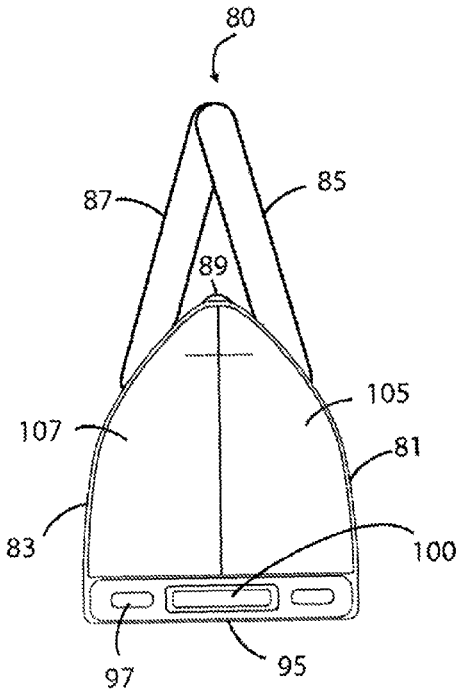
FIG. 6 is a right side view thereof.

FIGS. 3 and 4 show another embodiment of a representation of the present invention wherein the storage units are different and one includes a pad and pen holder. Present invention handbag 40 includes a main support having three connected fold-out panels, one of the fold-out panels is a base panel 45 located between the other panels, namely left panel 43 and right panel 47. There are two fold areas 49 and 51 located between the panels 43, 45 and 47, as shown. A personal electronic device holding case 57 is located on and attached to the base panel 45. The holding case 57 has sides with securing means for securing a personal electronic device (not shown) thereto. These are two storage units, shown, each with sides and a bottom. Storage unit is a pen and paper storage unit 77 with a bottom 65 and with its side connected to or physically part of left panel 43. Storage unit 75 is a bag storage unit with a bottom 69 and with its side connected to or physically part of right panel 47. In general, at least one of at least two storage units is a bag storage unit, and in this case one is a bag storage unit. One of each storage unit is connected at its side to a panel, i.e., panels, 43 and 47, respectively, so as to be on opposite sides of the base panel 45, as shown. The main support has a first position, being a closed position, shown in FIG. 4, wherein the panels 43, 45 and 47 are folded and the storage unit bottoms 65 and 69 rest atop the holding case 57 and any personal electronic device (not shown) therein to protect such personal electronic device. It also has a second position, being an open position, shown in FIG. 3, wherein the panels 43, 45 and 47 are unfolded and the storage unit bottoms 65 and 69 are not resting upon the holding case 57 so as to expose the holding case 57 and any personal electronic device therein, for use of the personal electronic device. Holding case 57 has open ends for functional aspects of the personal electronic device, and here, at this end, holding case 57 has orifices 59 and 61 to expose functional parts of the personal electronic device, such as buttons, lights, parts, charge sockets, etc. The opposite end of holding case 57 (not shown) likewise has functional orifices, e.g. a charge socket opening FIG. 5 is a left side view of yet another embodiment of the present invention personal electronic device handbag 80, and FIG. 6 is a right side view thereof. The present invention handbag 80 is set forth in FIGS. 5 through 10 and identical parts are identically numbered and, hence, need not be repeated in their entirety with respect to each individual Figure.

Figure 7:
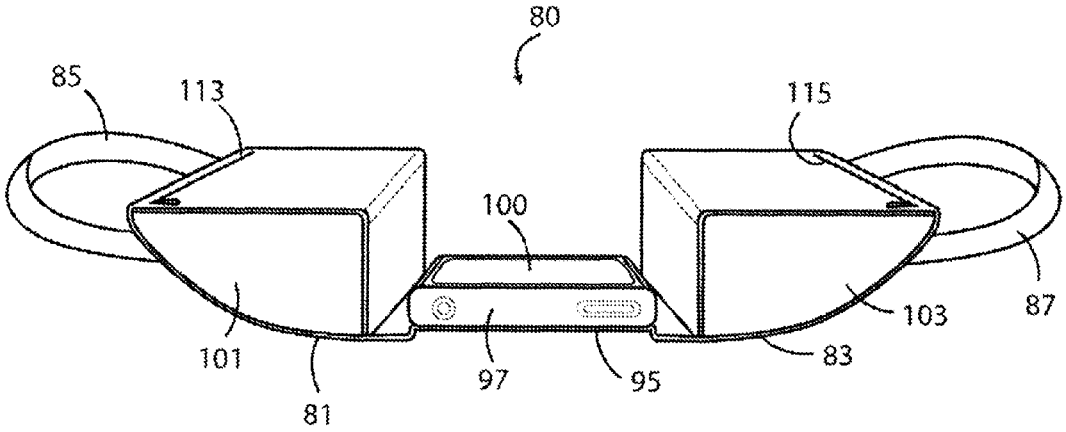
FIG. 7 is a left side oblique view of the present invention personal electronic device handbag set forth in FIGS. 5 and 6, in its open position.
Figure 8:
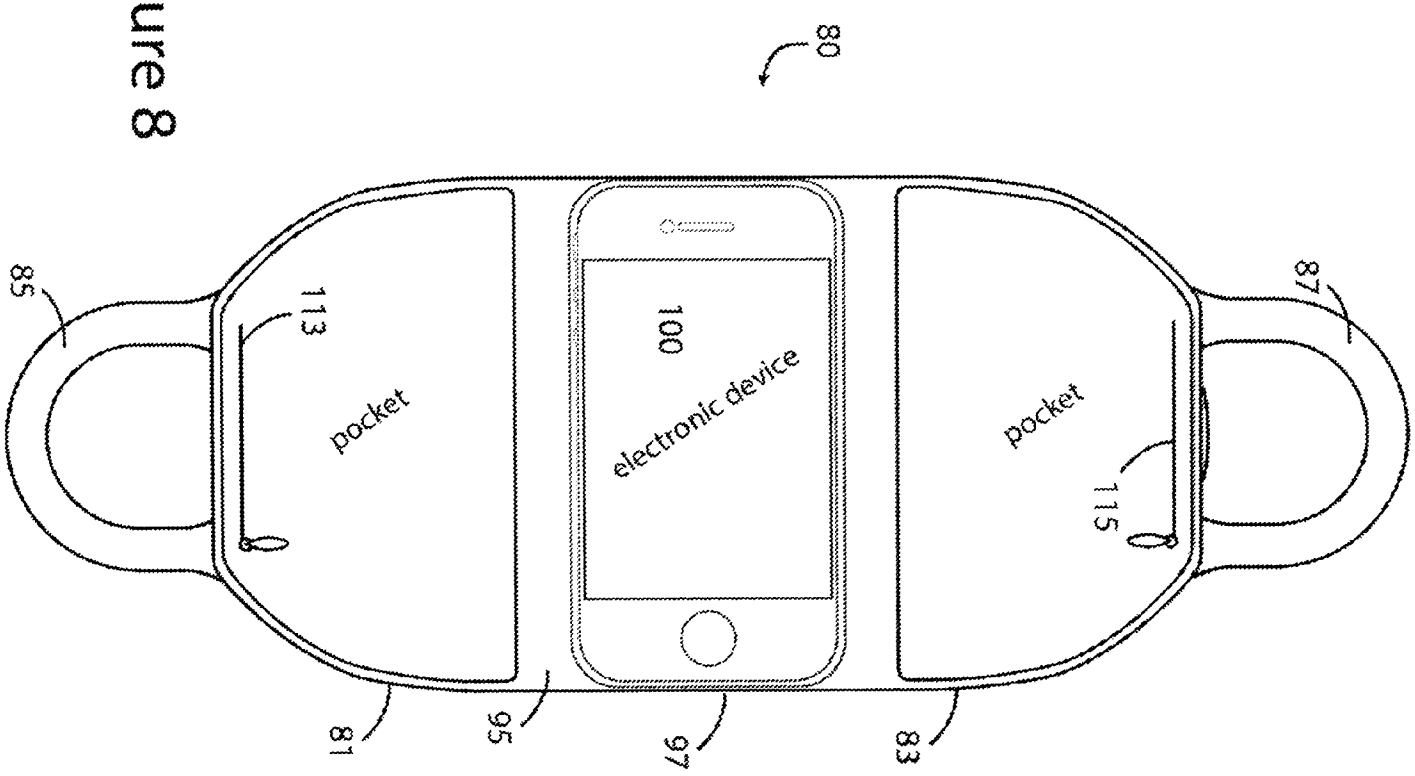
FIG. 8 is a top view of the present invention personal electronic device handbag shown above in its open position.

In FIGS. 5 and 6, present invention handbag 80 is illustrated in side views. They both show handles 85 and 87, latch 89, cell phone 100 and the main support panels. These are central base panel 95, left panel 81 and right panel 83. Both also show personal electronic device (cell phone 100) holding case 97 with its cell phone function-aligned orifices. The two storage units are attached to panels 81 and 83, respectively, and their left sides 101 and 103 and right sides 105 and 107 are shown in FIGS. 5 and 6. FIG. 7 shows present invention handbag 80 from a left side oblique view with zippers 113 and 115 exposed. In the alternative, these zippers could be located on the top of each storage unit for easier access, but are more secure when positioned as shown in FIG. 7. FIG. 8 shows a top view of present invention personal electronic device handbag 80 with identical parts identically numbered.

Figure 9:
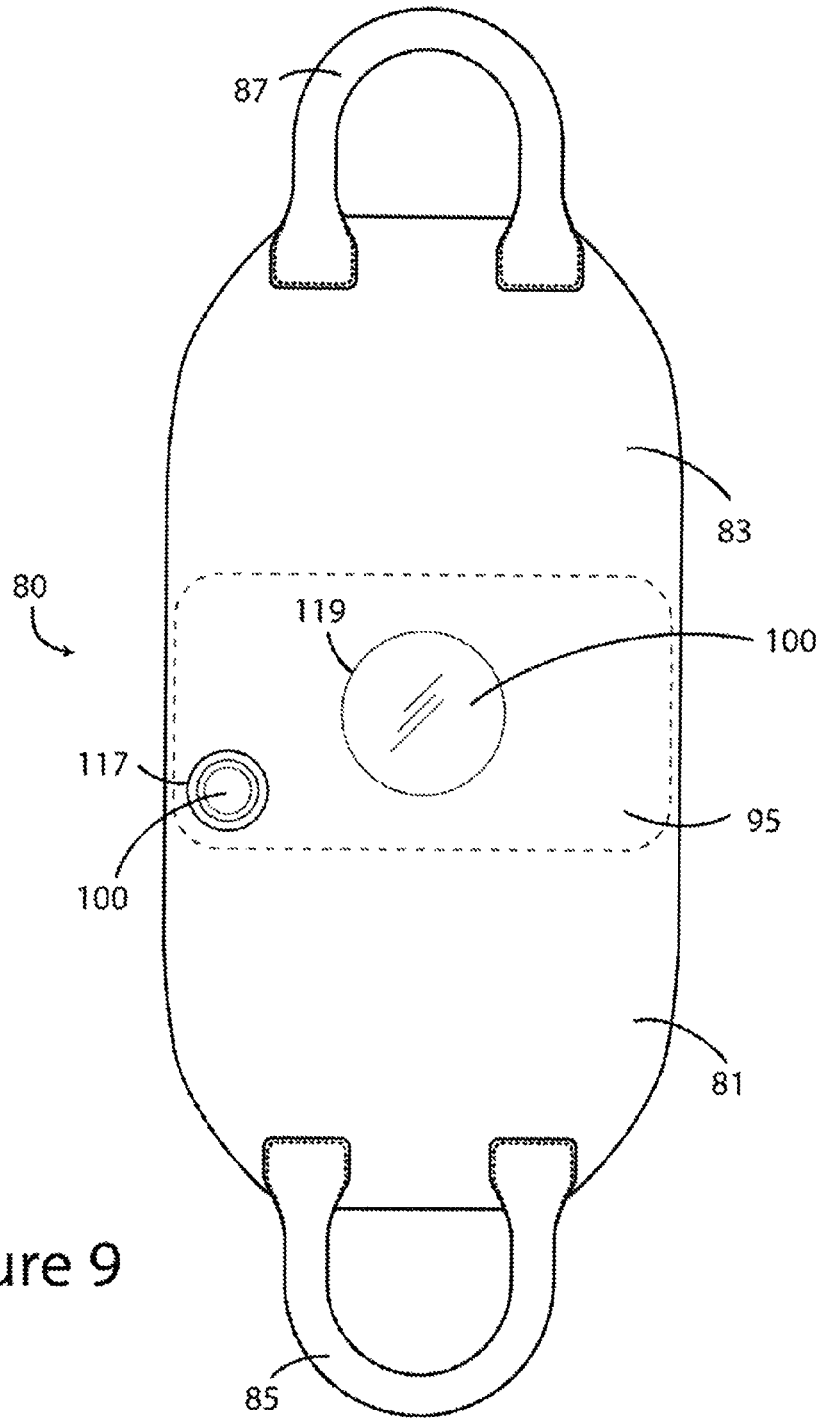
FIG. 9 shows a bottom view of the present invention personal electronic device handbag shown in FIGS. 4 through 8 above.

FIG. 9 shows a bottom view of the present invention personal electronic device handbag 80 shown in FIGS. 4 through 8 above. In this Figure, orifices 117 and 119 are cut into central base panel 95 with cell phone 100 and its camera lens 110 exposed as shown. Without removing cell phone 100 from its holding carrier, a user may open panels 81 and 83 and take a digital photo in the otherwise usual steps.

Figure 10:
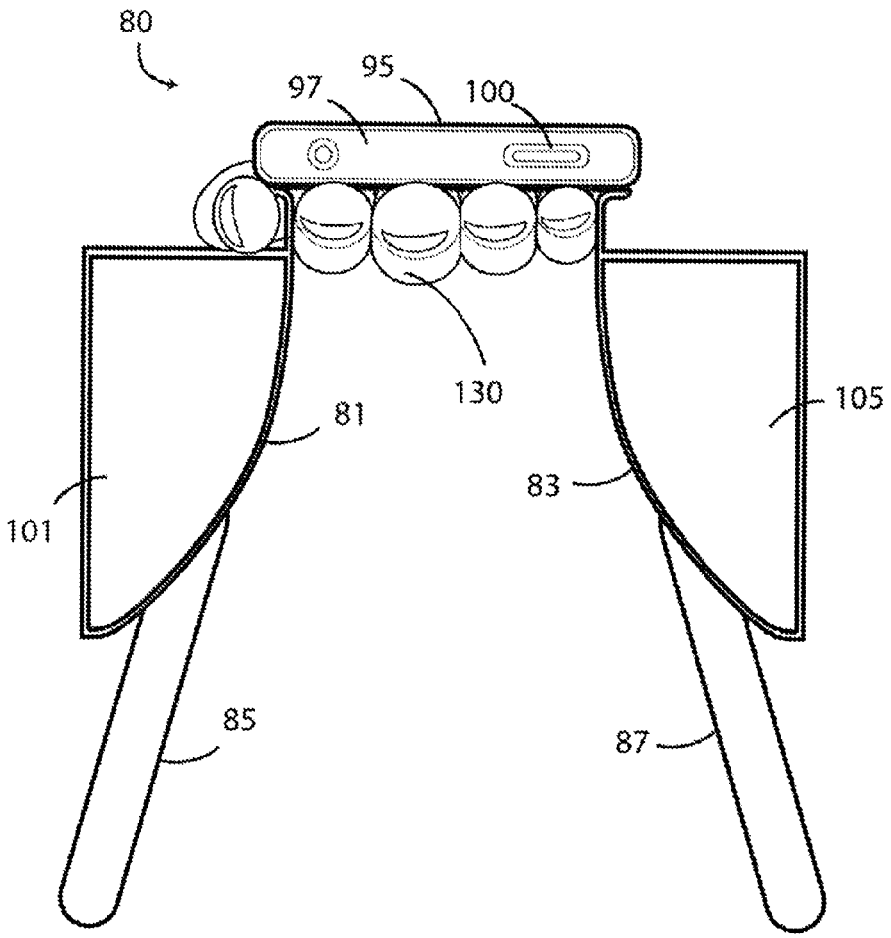
FIG. 10 show a left side full open and hanging view of the present invention personal electronic device handbag, in a left hand of a user, shown in FIGS. 4 through 9.

FIG. 10 show a left side full open and hanging view of the present invention personal electronic device handbag, in a left hand of a user, shown in FIGS. 4 through 9. In this Figure it can be seen at hand 130 easily holds present invention handbag 80 fully open to enable a user to hold it and operate a personal electronic device, e.g. to use a calendar or text or calculator on such a device.

Figure 11:
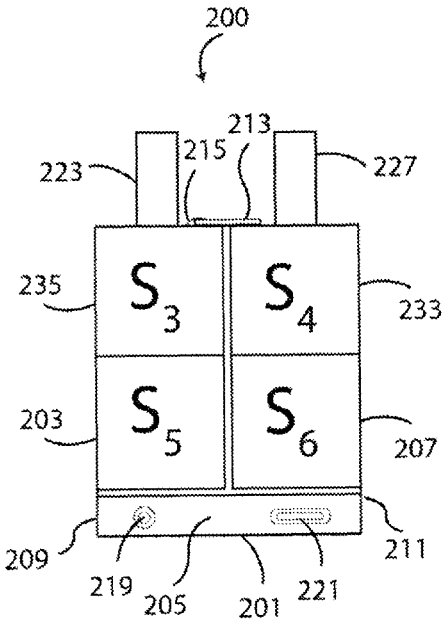
FIG. 11 shows a side view of another present invention personal electronic device handbag having four different storage units.
Figure 13:
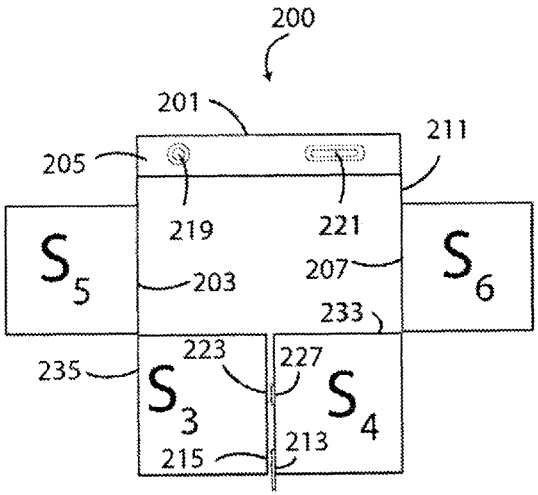
FIGS. 12 and 13 show the same handbag in horizontal open and vertical stand open positions, respectively.
Figure 12:
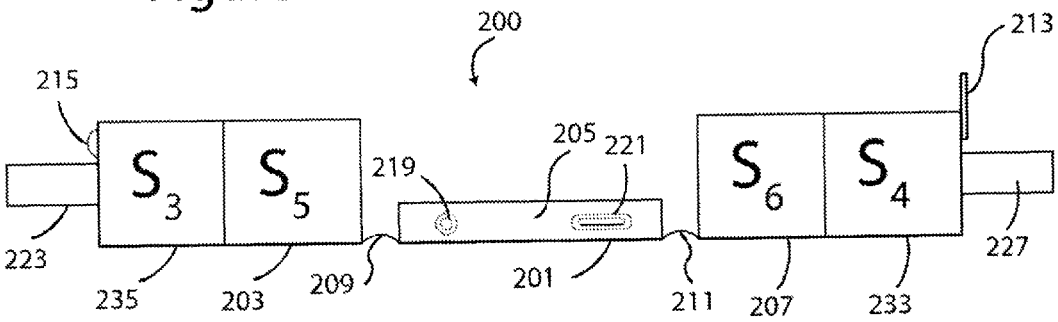

FIG. 11 shows a side view of another present invention personal electronic device handbag 200 having four different storage units, and FIGS. 12 and 13 show the same handbag in horizontal open and vertical stand open positions, respectively. In FIGS. 11, 12 and 13, present invention handbag 200 has identical parts identically numbered. These include five panels and three folds, one panel for the holding case and four for one side of each of the storage units. Thus, a central base panel 201 includes the personal electronic device holding case 205 attached to it. Additional panels are panels 203, 235, 207 and 233. Between central base panel 201 and panel 203 is fold 209. Likewise, between central base panel 201 and panel 207 is fold 211. Folds 209 and 211 are wide folds to cover the height of holding case 205. There are smaller fold between panels 203 and 235 (storage units S3 and S5) and between panels 207 and 233 (storage units S4 and S6). Carrying case 205 includes functional orifices 219 and 221. Handles 223 and 227 are flexible straps, and closures 213 and 215 are any conventional closure components. FIG. 11 illustrates present invention handbag 200 in its closed carrying position; FIG. 12 shows it in its horizontal position; FIG. 13 shows it open with the flexible straps folded in and a stand position.

Figure 14:
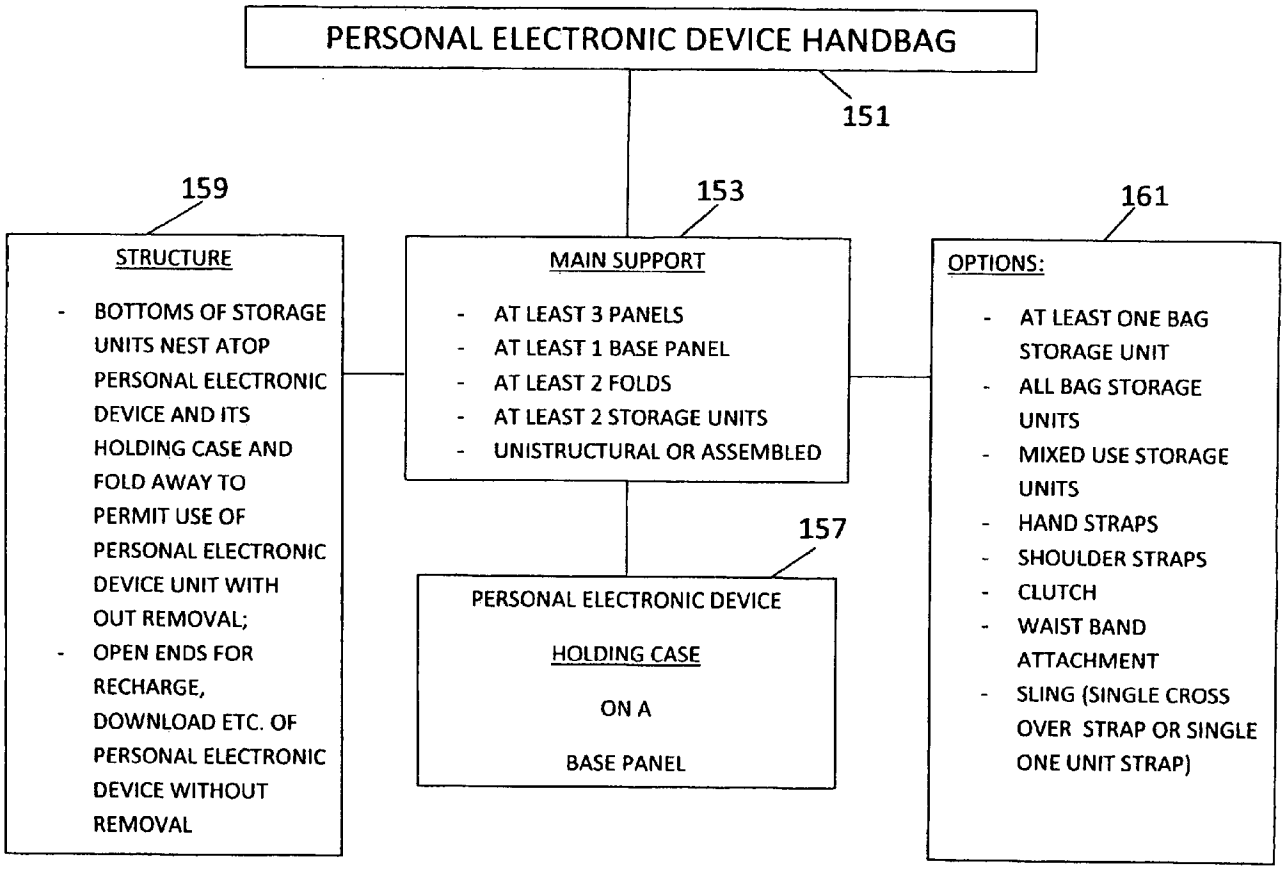
FIG. 14 provides a block diagram of the variations of the present invention personal electronic device handbag; and, FIGS. 15, 16, 17, 18 and 19 show examples of alternative functional and aesthetic designs for the present invention personal electronic device handbag.

FIG. 14 provides a block diagram of the variations of the present invention personal electronic device handbag 151. Personal electronic device handbag 151 includes features for main support 153 with holding case 157. Structures 159 describe critical elements and options 161 after design alternatives.

FIGS. 15, 16, 17, 18 and 19 show examples of alternative functional and aesthetic designs for the present invention personal electronic device handbag.

Figure 15:
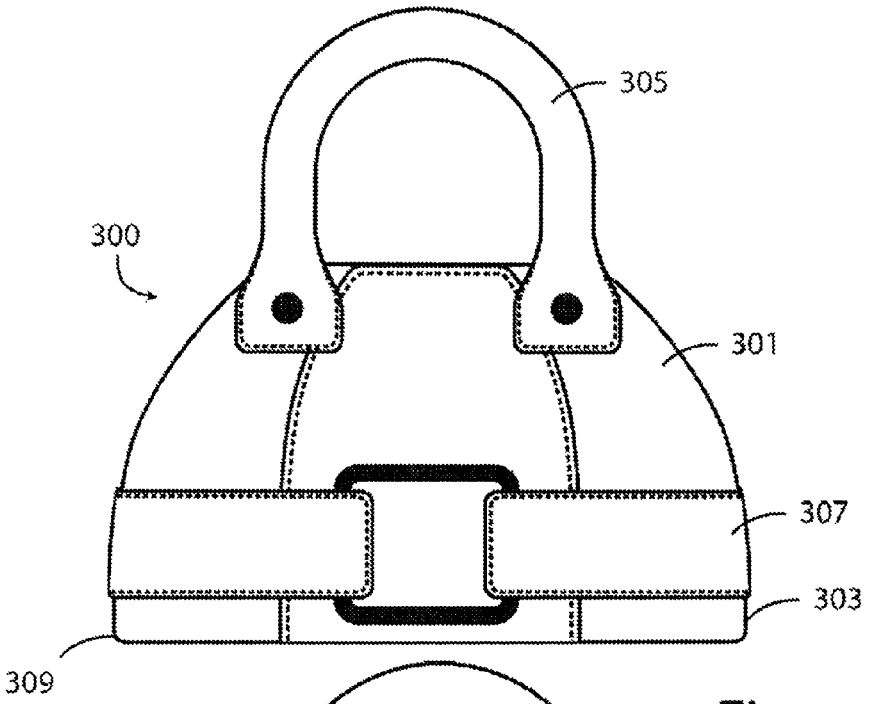

FIG. 15 illustrates present invention personal electronic device handbag 300 with handles 305, main support 301, decorative strap 307 and open sides 303 and 309 for personal electronic device functional exposure.

Figure 16:
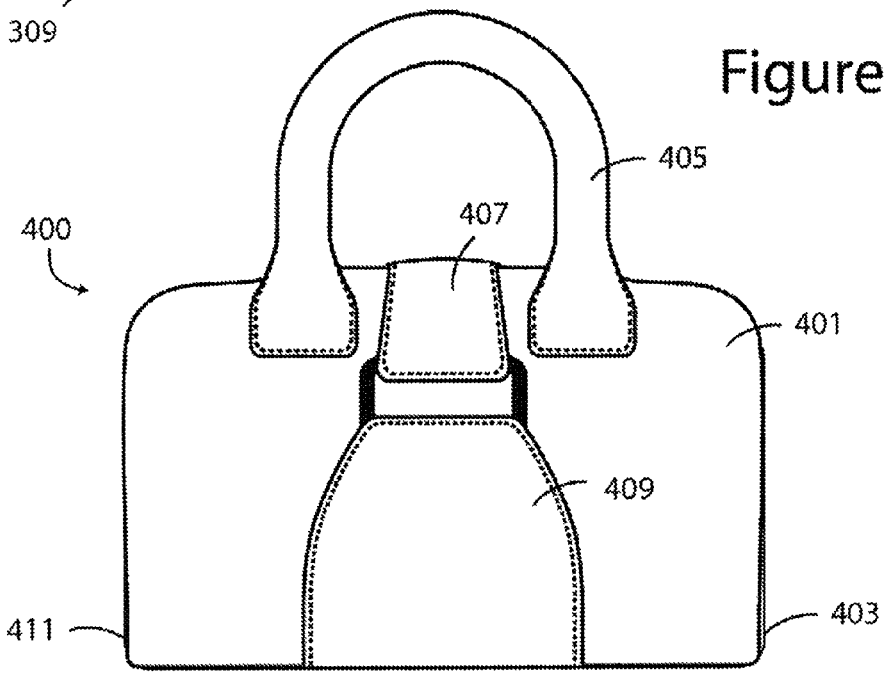

FIG. 16 illustrates present invention personal electronic device handbag 400 with handles 405, main support 401, decorative strap 409 and open sides 403 and 411 for personal electronic device functional exposure. It also has a matching cross-over strap 407.

FIG. 17 illustrates present invention personal electronic device handbag 500 with shoulder straps 509, main support 501, clasps 503 and 505 and open sides 507 and 511 for personal electronic device functional exposure.

FIG. 18 illustrates present invention personal electronic device handbag 600 with handles 609, main support 601, decorative strap 603 and open sides 607 and 611 for personal electronic device functional exposure.

FIG. 19 illustrates present invention personal electronic device handbag 700, clutch design, with main support 701 and open sides 703 and 711 for personal electronic device functional exposure.

Figure 20:
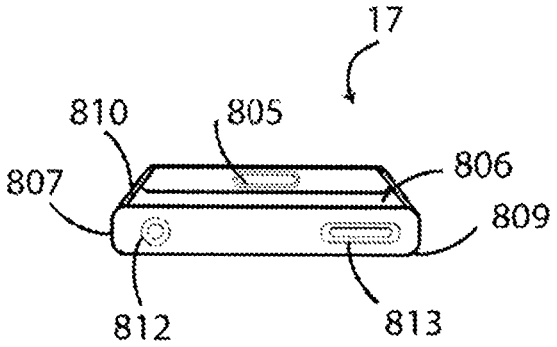
FIG. 20 is an illustration of a holding device in the securing means of the present invention.

FIG. 20 is an illustration of a holding device 17 in the securing means 810 of the present invention. The sides 807 of the securing means wrap around the edge of the holding device 17. Orifices 812, 813, 805 and 809 are sized to expose functional parts of the electronic device such as charger, head set, on/off button, volume buttons, camera lens and flash, for example. Opening 806 is sized to expose the entire face of the electronic device.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A personal electronic device handbag, which comprises: (a) a main support having at least three connected fold-out panels including at least one of said fold-out panels being a base panel located between other panels, and at least two fold areas located between said panels; (b) a personal electronic device holding case located on and attached to said base panel, said holding case having sides with securing means for securing a personal electronic device thereto; (c) at least two storage units having sides and a bottom, at least one of said at least two storage units is a bag storage unit, at least one of each being connected at its side to panels on opposite sides of said base panel, such that said main support has a first position, being a closed position, wherein said panels are folded and at least two of said storage unit bottoms rest atop said holding case and any personal electronic device therein to protect such personal electronic device, and has a second position, being an open position, wherein said panels are unfolded and said at least two storage unit bottoms are not resting upon said holding case so as to expose said holding case and any personal electronic device therein for use of said personal electronic device.

2. The personal electronic device handbag of claim 1, wherein said personal electronic device holding case is positioned on the base panel of said main support so as to receive a personal electronic device with its back facing said base panel and its front facing upward and available for use while positioned in said holding case when said main support is in its open position.

3. The personal electronic device handbag of claim 1, wherein said main support and said personal electric device holding case have sufficient open areas to permit recharging of a personal electric device while stored in said holding case and while said main support is in its closed position.

4. The personal electronic device handbag of claim 1, wherein at least three connected fold out panels are rigid.

5. The personal electronic device handbag of claim 1, wherein at least one base panel is rigid and the remaining panels are non-rigid.

6. The personal electronic device handbag of claim 1, wherein said handbag main support has at least one carrying strap attached to said main support.

7. The personal electronic device handbag of claim 6, wherein said handbag main support has two carrying straps attached to said main support.

8. The personal electronic device handbag of claim 1 wherein each of said at least one bag storage unit has closure means selected from the group consisting of zipper, magnetic, hook and loop, snap and clasp.

9. A personal electronic device handbag, which comprises: a. a main support having three connected fold-out panels including one of said fold-out panels being a central base panel located between other two panels, and two fold areas located between said panels, wherein the main support has a bottom orifice at its central base panel positioned for alignment with a camera lens of a personal electronic device; b. a personal electronic device holding case located on and attached to said central base panel, said holding case having sides with securing means for securing the personal electronic device thereto; c. at least two storage units having sides and a bottom, at least one of said at least two storage units is a bag storage unit, at least one of each being connected at its side to panels on opposite sides of said central base panel, such that said main support has a first position, being a closed position, wherein said panels are folded and at least two of said storage unit bottoms rest atop said holding case and any personal electronic device therein to protect such personal electronic device, and has a second position, being an open position, wherein said panels are unfolded and said at least two storage unit bottoms are not resting upon said holding case so as to expose said holding case and any personal electronic device therein for use of said personal electronic device.

10. The personal electronic device handbag of claim 9, wherein said personal electronic device holding case is positioned on the central base panel of said main support so as to receive a personal electronic device with its back facing said central base panel and its front facing upward and available for use while positioned in said holding case when said main support is in its open position.

11. The personal electronic device handbag of claim 9, wherein said main support and said personal electric device holding case have sufficient open areas to permit recharging of a personal electric device while stored in said holding case and while said main support is in its closed position.

12. The personal electronic device handbag of claim 9, wherein at least three connected fold out panels are rigid.

13. The personal electronic device handbag of claim 9, wherein at least one central base panel is rigid and the remaining panels are non-rigid.

14. The personal electronic device handbag of claim 9, wherein said handbag main support has at least one carrying strap attached to said main support.

15. The personal electronic device handbag of claim 9 wherein each of said at least one bag storage units have closure means selected from the group consisting of zipper, magnetic, hook and loop, snap and clasp.

16. The personal electronic device handbag of claim 9 wherein said at least two storage units include at least two bag storage units.

* * * * *